US007617709B2

(12) United States Patent
Sano et al.

(10) Patent No.: US 7,617,709 B2
(45) Date of Patent: Nov. 17, 2009

(54) APPARATUS FOR CONTROLLING MATERIALS QUALITY IN ROLLING, FORGING, OR LEVELING PROCESS

(75) Inventors: Mitsuhiko Sano, Tokyo (JP); Kazuhiro Ohara, Tokyo (JP); Masashi Tsugeno, Tokyo (JP)

(73) Assignee: Toshiba Mitsubishi-Electric Industrial Systems Corporation, Tokyo (JP)

( * ) Notice: Subject to any disclaimer, the term of this patent is extended or adjusted under 35 U.S.C. 154(b) by 352 days.

(21) Appl. No.: 10/584,773

(22) PCT Filed: Oct. 14, 2004

(86) PCT No.: PCT/JP2004/015169

§ 371 (c)(1),
(2), (4) Date: Jun. 28, 2006

(87) PCT Pub. No.: WO2006/040823

PCT Pub. Date: Apr. 20, 2006

(65) Prior Publication Data

US 2007/0151635 A1 Jul. 5, 2007

(51) Int. Cl.

| | |
|---|---|
| ***B21B 37/16*** | (2006.01) |
| ***B21B 37/00*** | (2006.01) |
| ***B21B 37/44*** | (2006.01) |
| ***B21B 37/74*** | (2006.01) |
| ***B21B 38/00*** | (2006.01) |

(52) U.S. Cl. ..... 72/7.1; 72/8.3; 72/14.8; 72/16.3; 72/17.3; 72/342.1

(58) Field of Classification Search ..... 72/7.1, 72/7.4, 7.6, 8.3, 8.9, 9.1, 9.2, 11.1, 11.2, 72/8.5, 12.2, 8.4, 11.5, 12.5, 14.8, 16.1–16.4, 72/17.3, 18.1, 18.2, 18.5, 342.1, 342.2, 342.5
See application file for complete search history.

(56) References Cited

U.S. PATENT DOCUMENTS 5,241,847 A 9/1993 Tsugeno et al.

(Continued)

FOREIGN PATENT DOCUMENTS

DE 199 41 736 A1 3/2001

(Continued)

OTHER PUBLICATIONS

Advanced Technology for Strip Rolling; pp. 198-229, Corona Publishing CP., Ltd. (1993).

(Continued)

*Primary Examiner*—Dana Ross
*Assistant Examiner*—Debra M Sullivan
(74) *Attorney, Agent, or Firm*—Leydig, Voit & Mayer, Ltd.

(57) ABSTRACT

The invention matches the material quality of a product to target data, even when a materials quality model is insufficient in prediction accuracy. Heating a metallic material, rolling, forging, or leveling the metallic material, and cooling the metallic material are each conducted at least once. Prior to manufacture of a metallic product of a desired size and shape, qualitative data of the metallic material are measured at a position by materials, quality sensor in a manufacturing line, and modifications based on measured data are made to heating, processing, or cooling conditions in at least one of the steps, upstream of the materials measured data sensor so that the quality of the metallic material at the measuring position agrees with target data.

4 Claims, 5 Drawing Sheets

U.S. PATENT DOCUMENTS

| | | | | |
|---|---|---|---|---|
| 7,251,971 | B2 | 8/2007 | Reinschke et al. | |
| 2006/0117549 | A1* | 6/2006 | Plocoennik et al. | 29/592.1 |

FOREIGN PATENT DOCUMENTS

| | | | |
|---|---|---|---|
| DE | 102 56 750 | A1 | 6/2004 |
| JP | 56-082443 | | 7/1981 |
| JP | 57-057255 | | 4/1982 |
| JP | 02-210258 | | 8/1990 |
| JP | 03-285706 | | 12/1991 |
| JP | 04-002957 | | 1/1992 |
| JP | 04-361158 | | 12/1992 |
| JP | 2001-255306 | | 9/2001 |
| JP | 2001-349883 | | 12/2001 |
| JP | 2003-268428 | | 9/2003 |
| WO | WO 2004/007605 | A2 | 9/2004 |

OTHER PUBLICATIONS

"Development of On-line Control System for Mechanical Properties on the Plate Rolling Mill", Current Advances in Materials and Processes, vol. 17 (2004); pp. 227-228, The Iron and Steel Institute of Japan.

* cited by examiner

APPARATUS FOR CONTROLLING MATERIALS QUALITY IN ROLLING, FORGING, OR LEVELING PROCESS

TECHNICAL FIELD

The present invention relates to a method and apparatus for controlling materials quality in a rolling, forging, or leveling process. The above method and apparatus are intended to manufacture a product of a desired size and shape by conducting a heating process, a rolling, forging, or leveling process, and a cooling process each at least once for a metallic raw material.

BACKGROUND ART

The mechanical characteristics (e.g., strength, formability, and tenacity), electromagnetic characteristics (e.g., magnetic permeability), and other properties of metallic materials inclusive of ferroalloys and aluminum alloys vary not only with the chemical composition of the particular alloy, but also with its heating conditions, its processing conditions, and its cooling conditions. The composition of an alloy is conditioned by controlling an adding rate of constituent element(s). The lot sizes of products during quality governing, however, are too great to change an actual adding rate for each product. To manufacture products of desired quality, therefore, it is very important to enhance product quality by establishing appropriate heating, processing, and cooling conditions.

A typical traditional control method has been by determining independent data based on many years of experience, such as a heating temperature target value, after-processing dimensional target value, and cooling rate target value, for heating, processing, and cooling conditions each, and for each set of product specifications, and then conducting temperature control and dimensional control to attain the above target data. In recent years, however, the significantly growing sophisticatedness and diversity of the product specifications called for have caused a case in which the desired materials quality cannot be obtained because of appropriate target data not always being determined using such an experiential method.

In recent years is therefore known a control method in which a materials quality model for estimating product quality from heating conditions, processing conditions, and cooling conditions, is used to determine these conditions for each process through computations to obtain the product quality matching to target data. Patent Reference 1, for example, describes such a control method.

Another known method is by sampling measured plate thickness and materials temperature data during rolling and then using these data samplings as input data for a materials quality model in order to improve accuracy. In this method, before the rolling of a steel material is started, the materials quality model is used to determine the heating conditions, rolling conditions, and cooling conditions of the steel material from its composition data, its after-rolling size, and its guaranteed quality data. In addition, when measured plate thickness, material temperature, interpass time, roll diameter, and roll speed data is obtained following completion of a heating process, a pre-rolling process, and a finish-rolling process, a schedule concerning the next and subsequent rolling or cooling process conditions, based on the measured data, is set up using the materials quality model to suppress variations in product quality. Patent Reference 2, for example, describes such a control method.

Meanwhile, a control method that uses a neural network in lieu of a materials quality model is known. This method is used to examine the characteristics of processed or heat-treated metallic materials and assign examination results as teaching data to a neural network to improve the accuracy of prediction with the neural network. Patent Reference 3, for example, describes such a control method.

[Patent Reference 1] Japanese Patent Publication No. 7-102378

[Patent Reference 2] Japanese Patent No. 2509481

[Patent Reference 3] Japanese Patent Laid-open No. 2001-349883

DISCLOSURE OF THE INVENTION

Problems to be Solved by the Invention

In the above-outlined control method based on a materials quality model, the prediction accuracy of the materials quality model becomes a key point to matching product quality to target data. The relationship between heating, processing, and cooling conditions and the quality of products, however, is very complex, so although various model equations are proposed that include, for example, a theoretical or empirical equation based on the utilization of a metallographical theory or of thermodynamic data and a regression equation based on actual plant operation data, none of materials quality models based on these equations have not always been satisfactory in prediction accuracy. The deterioration of the accuracy has been significant, particularly when either the heating conditions, the processing conditions, the cooling conditions, or the composition of the alloy was excluded from identification with the materials quality model (in terms of alloy composition, for example, such applies more particularly to multi-means alloys other than C—Si—Mn series iron and steel materials). In addition, even if the large number of model equations forming the materials quality model are each highly accurate in themselves, since the respective errors are stacked on one another, it has been difficult to maintain high total accuracy. For these reasons, the problem of quality being unable to be matched to target data because of the insufficient accuracy of the materials quality model itself has still remained unsolvable, even by using the foregoing control method based on a materials quality model.

In the control method that uses a neural network in lieu of a materials quality model, although the characteristics of processed or heat-treated metallic materials are examined and examination results are assigned as teaching data to a neural network to improve the accuracy of prediction with the neural network, there has been a problem in that accuracy improvement becomes a time-consuming operation for the reasons below. That is, the relationship between heating, processing, and cooling conditions and the quality of products is very complex as mentioned above, and to simulate this relationship accurately, a large-scale neural network spanning a large number of hierarchical levels is required and a vast volume of teaching data must be given for the neural network to learn the relationship. Using a smaller-scale neural network, of course, correspondingly reduces the teaching data volume required, but in that case, there has been another problem in that an applicable plant-operating range is limited.

The present invention has been made in order to solve the above problems, and an object of the invention is to match product quality to target data, even when a materials quality model is not high enough in prediction accuracy.

Means for Solving the Problem

The present invention provides a method for controlling materials quality in a rolling, forging, or leveling process, the method comprising:

conducting, at least once, each of the heating step of heating a metallic material, the processing step of rolling, forging, or leveling the metallic material, and the cooling step of cooling the metallic material; and prior to manufacture of a metallic product of a desired size and shape, measuring qualitative data of the metallic material at a position by means of a materials quality sensor installed in a manufacturing line, and then in accordance with the measured data, making modifications to heating, processing, or cooling conditions in at least one of the steps upstream with respect to the materials quality sensor so that the quality of the metallic material at the measuring position agrees with target data.

Also, the present invention provides a method for controlling materials quality in a rolling, forging, or leveling process, the method comprising:

conducting, at least once, each of the heating step of heating a metallic material, the processing step of rolling, forging, or leveling the metallic material, and the cooling step of cooling the metallic material; and prior to manufacture of a metallic product of a desired size and shape, measuring qualitative data of the metallic material at a position by means of a materials quality sensor installed in a manufacturing line, comparing the measured data with metallic material quality data estimates at the measuring position that have been calculated from actual heating conditions, processing conditions, and cooling conditions of the metallic material by use of a materials quality model, modifying the materials quality model in accordance with the comparison results, and determining subsequent heating conditions, processing conditions, and cooling conditions of the metallic material in the respective steps, by use of the modified materials quality model.

Also, the present invention provides a method for controlling materials quality in a rolling, forging, or leveling process, the method comprising:

conducting, at least once, each of the heating step of heating a metallic material, the processing step of rolling, forging, or leveling the metallic material, and the cooling step of cooling the metallic material; and prior to manufacture of a metallic product of a desired size and shape, measuring qualitative data of the metallic material at a position by means of a materials quality sensor installed in a manufacturing line, comparing the measured data with metallic material quality data estimates at the measuring position that have been calculated from actual heating conditions, processing conditions, and cooling conditions of the metallic material by use of a materials quality model, modifying the materials quality model in accordance with the comparison results, and determining subsequent heating conditions, processing conditions, and cooling conditions of the metallic material in the respective steps, by use of the modified materials quality model.

Also, the present invention provides a method for controlling materials quality in a rolling, forging, or leveling process, the method comprising:

conducting, at least once, each of the heating step of heating a metallic material, the processing step of rolling, forging, or leveling the metallic material, and the cooling step of cooling the metallic material; and prior to manufacture of a metallic product of a desired size and shape, measuring qualitative data of the metallic material by means of a materials quality sensor installed in a manufacturing line, and then in accordance with measured data, making modifications to heating, processing, or cooling conditions of the metallic material in at least one of the steps downstream with respect to the materials quality sensor by means of a materials quality model so that the quality of the metallic material at a materials quality control point provided in any position downstream with respect to the materials quality sensor will agree with target data.

Also, the present invention provides an apparatus for controlling materials quality in a rolling, forging, or leveling process, the apparatus comprising:

at least one means for each of heating a metallic material, rolling, forging, or leveling the metallic material, and cooling the metallic material;

data settings calculation means connected to a manufacturing line for manufacturing a metallic product of a desired size and shape, wherein, in accordance with information on a size and shape of the metallic material, on a target size and shape of the product, and on composition and other factors of the metallic material, the information being given from a host computer, the data settings calculation means calculates and outputs data settings on the heating means, the processing means, and the cooling means;

a heating controller, a processing controller, and a cooling controller which control a heater, a processor, and a cooler, respectively, on the basis of the data settings;

a materials quality sensor installed in the manufacturing line in order to measure qualitative data of the metallic material; and heating correction means, processing correction means, and cooling correction means, each of which, to ensure that the data measured by the materials quality sensor will agree with target data, corrects the data settings output from the data settings calculation means to the heating means, processing means, and cooling means disposed upstream with respect to the materials quality sensor.

Also, the present invention provides an apparatus comprising:

a materials quality sensor installed in the manufacturing line in order to measure, at a position, qualitative data of the metallic material;

materials quality model computing means for estimating, by means of a materials quality model, the quality of the metallic material at the measuring position from actual heating conditions, processing conditions, and cooling conditions of the metallic material;

materials quality model learning means for conducting comparisons between data measurements by the materials quality sensor and arithmetic results by the materials quality model computing means, and learning an error of the materials quality model; and materials quality model correction means for correcting the materials quality model by correcting the arithmetic results of the materials quality model computing means in accordance with the learning results obtained by the materials quality model learning means;

wherein the data settings calculation means calculates and outputs data settings on each of the heating means, the processing means, and the cooling means, in accordance with the as-corrected-material quality data estimates that the materials quality model correction means outputs.

Also, the present invention provides an apparatus comprising:

a materials quality sensor installed in the manufacturing line in order to measure qualitative data of the metallic material; and materials quality model computing means for estimating, by means of a materials quality model, the quality of the metallic material at a materials quality control point provided in any position downstream with respect to the materials quality sensor;

wherein the data settings calculation means calculates and outputs data settings on each of the heating means, the processing means, and the cooling means so that arithmetic results by the materials quality model computing means will agree with the target data given from the host computer.

Also, the present invention provides an apparatus comprising:

a materials quality sensor installed in a manufacturing line in order to measure qualitative data of the metallic material; and heating correction means, processing correction means, and cooling correction means, each of which, to ensure that the quality of the material at a materials quality control point provided in any position downstream with respect to the materials quality sensor will agree with the target data given from the host computer, correct the data settings output from the data settings calculation means to the heating means, processing means, and cooling means disposed downstream with respect to the materials quality sensor.

Effects of the Invention

According to the present invention, quality of a material at a measuring position by a materials quality sensor can be controlled for matching to target data. The materials subsequently processed also become controllable so that quality of each material at a measuring position by the materials quality sensor will match to target data. In addition, materials quality estimation errors due to variations in materials quality at the materials quality sensor position can be prevented from occurring, and the materials quality at a materials quality control point can be matched to target data. Furthermore, it is possible to prevent the occurrence of materials quality estimation errors due to variations in materials quality at the materials quality sensor position, and to maintain constant materials quality at a materials quality control point.

BEST MODE FOR CARRYING OUT THE INVENTION

Embodiments of the present invention will be described hereunder with reference to the accompanying drawings in order to detail the invention. A rolling process for iron and steel materials is taken as an example of a metallic-product manufacturing process in these embodiments. However, the invention is likewise applicable to the forging or leveling or other manufacturing process performed to manufacture a product of a desired size and shape by executing each of a heating process step, a processing step, and cooling process step, at least once for a metallic material.

Figure 5:
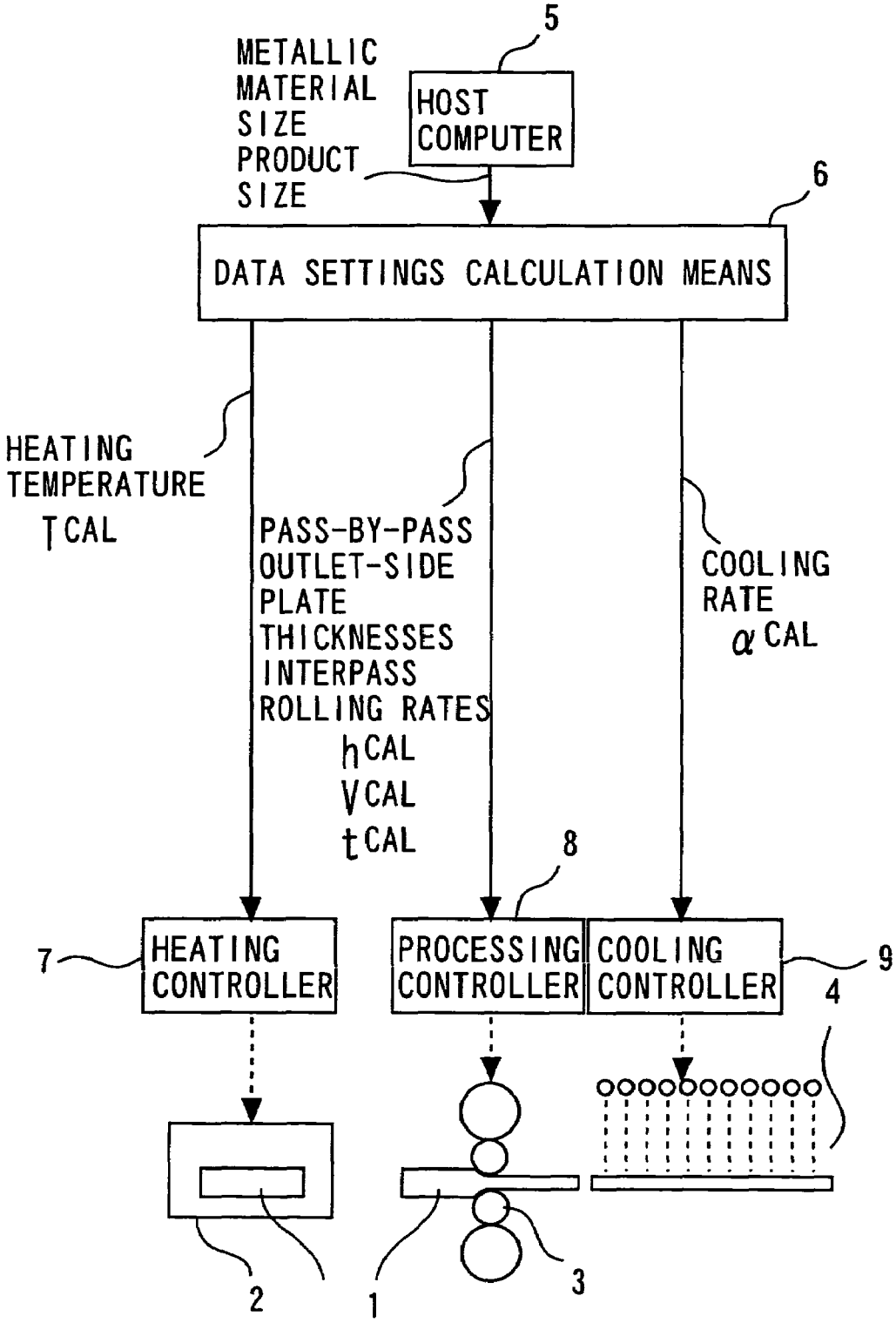
FIG. 5 is a block diagram showing the conventional method and apparatus for controlling materials quality in a rolling, forging, or leveling process, the present invention presupposing the conventional method and apparatus.

FIG. 5 is a block diagram showing the conventional method and apparatus for controlling materials quality in a rolling, forging, or leveling process, the present invention presupposing the conventional method and apparatus. As shown in FIG. 5, a metallic material 1 to be rolled, such as a ferroalloy or an aluminum alloy, is heated by a heater 2, then processed into a desired product size and shape by a processor 3 such as a rolling mill, and cooled by a cooler 4 to become a product. The heater 2, the processor 3, and the cooler 4 can each be provided in a plurality of positions. Also, these devices can be arranged in any order. The heater 2 generally heats the material by combusting a fuel gas. The heater 2, however, can be of a type which uses induction heating to heat the material. Temperature of the material after being heated differs according to a particular alloy composition of the metallic material, the processing method used, and the product specifications required. For hot- or warm-rolling a steel material into a thin plate, however, the above temperature ranges from about 500° C. to 1300° C. For hot- or warm-rolling an aluminum material into a thin plate, the temperature ranges from about 150° C. to 600° C. Although a reverse rolling mill or a tandem rolling mill is used as the processor 3, a forging machine or a leveler or the like can be used instead. The rolling mill has a motor drive for driving a roll, a rolling device for changing an angle of the roll, and/or other devices. These devices, however, are not shown. The rolling mill can reverse a rotational direction of its roll to deform the material a plurality of times. The cooler 4 supplies cooling water from a multi-pipe arrangement thereabove and therebelow to the surfaces of the material, thus lowering the temperature thereof. The cooling water piping includes a flow-regulating valve, an opening angle of which can be changed to change a cooling rate.

During control of the above rolling equipment, target data on a size and shape of the metallic material, on a target size and shape of a product, on composition (alloying element content) of the metallic material, and on other factors, is initially given from a host computer 5 to a data settings calculation means 6. In accordance with the information from the host computer 5, the data settings calculation means 6 allows for various restrictions and determines heating conditions, processing conditions, cooling conditions, and the like, so as to match the product size and shape to the target data. The heating conditions refer to a heating temperature $T^{CAL}$, a heating time, and others. The processing conditions refer to pass-by-pass outlet-side plate thicknesses (pass schedule) $h^{CAL}$, interpass rolling rates (roll-rotating speeds) $V^{CAL}$, interpass standby time periods $t^{CAL}$, and others of the rolling mill. The cooling conditions refer to a cooling rate $a^{CAL}$ at the cooler 4 downstream of the rolling mill, and other conditions. The restrictions include, for example, restrictions on a rolling load rating of the rolling device, restrictions on motor power, restrictions on an engagement angle with respect to the roll, equipment-operating restrictions on a rolling load for normal maintained levelness of the plate, and restrictions on maximum motor speed. Mathematical techniques for finding a solution under the restrictions include various known approaches such as linear programming and the Newton method. An appropriate one of these techniques can be selected considering solution-finding stability, a convergence rate, and other factors. Japanese Patent No. 26357996, for example, discloses such a pass schedule calculation method. In accordance with calculation results by the data settings calculation means 6, a heating controller 7 controls a flow rate of a fuel gas to be supplied to a heating furnace, controls the amount of electric power required for an induction heater, or changes an in-furnace dwelling time of the material. An input rate of heat to the material is thus adjusted. A processing (rolling) controller 8 controls the angle of the roll, a speed thereof, and others, in accordance with the calculation results by the data settings calculation means 6. A cooling controller 9 changes a cooling rate (operating speed of the cooler) by controlling a flow rate and pressure of the cooling water in accordance with the calculation results by the data settings calculation means 6.

FIRST EMBODIMENT

Figure 1:
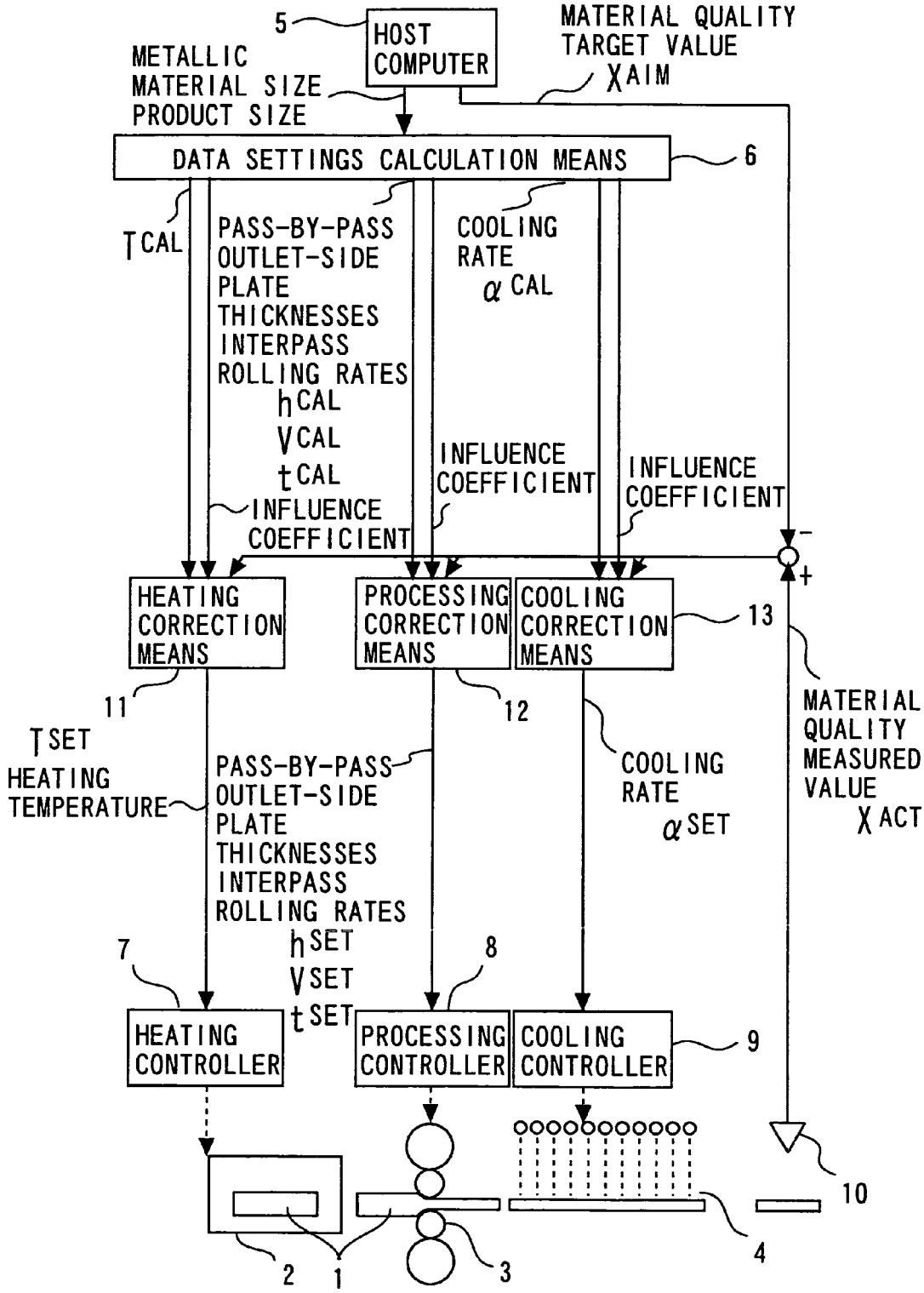
FIG. 1 is a block diagram showing a method and apparatus for controlling materials quality in a rolling, forging, or leveling process according to a first embodiment of the present invention.

FIG. 1 is a block diagram showing a method and apparatus for controlling materials quality in a rolling, forging, or leveling process according to a first embodiment of the present invention.

Operation of a data settings calculation means 6, a heating controller 7, a processing controller 8, a cooling controller 9, a heater 2, a processor 3, and a cooler 4, is the same as in the conventional method and apparatus underlying the present invention.

A materials quality sensor 10 is installed at any position downstream with respect to at least one of the heater 2, processor 3, and cooler 4 in an associated manufacturing line. The heater 2, processor 3, and cooler 4 upstream with respect to the materials quality sensor 10 can each be provided in a plurality of positions and arranged in any order. The materials quality sensor 10 is desirably of a non-contact and/or nondestructive type in terms of, for example, durability. The materials quality sensor 10 can be, for example, of a type which directly measures magnetic permeability and other materials properties. The sensor can otherwise be of a type which indirectly measures materials properties by detecting electrical resistance, ultrasonic propagation characteristics, radiation scattering characteristics, and/or other physical quantities that exhibit a strong correlation with quality of a material to be controlled, and converting detected physical quantities into a crystal grain size, formability data, and/or other quality-associated data of the material. Sensors such as the materials quality sensor 10 employ various detection methods. Japanese Patent Laid-open No. 57-57255, for example, discloses a method of measuring the crystal grain size or aggregate structure of a material in accordance with a change in intensity of the ultrasonic waves implanted in the material, and with detected propagation rate data. A laser ultrasonic device that has been developed in recent years, an electromagnetic ultrasonic device, or the like can be used to transmit/receive ultrasonic waves, and Japanese Patent Laid-open No. 2001-255306, for example, discloses an example of a laser ultrasonic device. Laser ultrasonic devices feature long ranging from the surface of a material to a materials quality sensor and is very useful particularly when hot measurement and on-line measurement are required. In addition, Japanese Patent Laid-open No. 56-82443 discloses a device that measures a transformation rate of a steel material from the magnetic flux intensity detected by a magnetic flux detector. Furthermore, Japanese Patent Publication No. 6-87054 discloses a Lankford value measuring method that utilizes electromagnetic ultrasonic waves.

In addition to target data on a size and shape of the metallic material, on a target size and shape of a product, on composition (alloying element content) of the metallic material, and on other factors, a material quality target value to be achieved at a measuring position of the materials quality sensor 10 is given from the host computer 5 to the data settings calculation means 6. The material quality here refers to some of mechanical characteristics such as tensile strength, yield strength, tenacity, and ductility, electromagnetic characteristics such as magnetic permeability, or the crystal grain size, preferred crystal orientation characteristics, abundance ratios of various crystalline structures that each have a strong correlation with the above mechanical and/or electromagnetic characteristics.

A heating correction means 11 conducts a heating temperature correction based on data measurements by the materials quality sensor 10, and outputs correction results to the heating controller 7. The correction uses, for example, the following expression:

[Numerical expression 1]

$$T^{SET} = T^{CAL} - \frac{w_1 \cdot K_1}{\left(\frac{\partial X}{\partial T}\right)} \cdot (X^{ACT} - X^{AIM}) \tag{1}$$

where $T^{SET}$ an after-correction heating temperature setting (° C.), $T^{CAL}$ a before-correction heating temperature setting (=calculated setting) (° C.), $X^{ACT}$ a value measured by the materials quality sensor, $X^{AIM}$ a material quality target value, $$\left(\frac{\partial X}{\partial T}\right)$$

an influence coefficient, $K_1$ a gain (–), and $w_1$ a weighting coefficient (–).

Gain $K_1$ is determined with response characteristics and others of the heater 2 taken into account. Weighting coefficient $w_1$ is determined in consideration of equipment-operating stability and a balance with the corrections conducted by the heating correction means 11, the processing correction means 12, and the cooling correction means 13. The influence coefficient is obtained by numerically differentiating a materials quality model (described later herein) as follows:

[Numerical expression 2]

$$\left(\frac{\partial X}{\partial T}\right) = \frac{X^{+} - X^{-}}{2 \cdot \Delta T} \tag{2}$$

where $\Delta T$ is a very insignificant variation (° C.), $X^+$ the material quality at the materials quality sensor position, based on the materials quality model calculations assuming that the heating temperature is increased by ΔT, and $X^-$ the material quality at the materials quality sensor position, based on the materials quality model calculations assuming that the heating temperature is reduced by ΔT.

Although the influence coefficient is desirably calculated on-line from actual equipment-operating conditions (such as the material temperature), if gain $K_1$ is reduced, a value that has been previously calculated off-line from standard operating conditions can be used as an alternative.

Using an induction heater makes it possible to adjust rapidly an increase rate of the material temperature by providing a semiconductor circuit or the like and changing the amount of electric power to be supplied to a coil. Using the induction heater is therefore preferred since this method allows enhancement of gain $K_1$ and more highly accurate material control.

Next, in accordance with data measurements by the materials quality sensor 10, the processing correction means 12 corrects pass-by-pass outlet-side plate thicknesses $h^{CAL}$, interpass rolling rates $V^{CAL}$, or interpass standby time periods $t^{CAL}$, so as to obtain appropriate processing conditions of the material at the processor 3, such as pass-by-pass deformation levels, pass-by-pass deformation rates, and pass-by-pass processing intervals. Correction results are output to the processing controller 8. Either interpass standby time period $t^{CAL}$, for example, is corrected using the following expression:

[Numerical expression 3]

$$t^{SET} = t^{CAL} - \frac{w_2 \cdot K_2}{\left(\frac{\partial X}{\partial t}\right)} \cdot (X^{ACT} - X^{AIM}) \tag{3}$$

where $t^{SET}$ an after-correction interpass time setting (sec), $t^{CAL}$ a before-correction interpass time setting (=calculated setting) (sec), $X^{ACT}$ a value measured by the materials quality sensor, $X^{AIM}$ a material quality target value, $$\left(\frac{\partial X}{\partial t}\right)$$

an influence coefficient, $K_2$ a gain (–), and $w_2$ a weighting coefficient (–).

Gain $K_2$ is determined considering factors such as a control delay time in transfer from a particular pass to the materials quality sensor 10. Weighting coefficient $w_2$ is determined in consideration of equipment-operating stability and the balance with the corrections conducted by the heating correction means 11, the processing correction means 12, and the cooling correction means 13. The influence coefficient is obtained by numerically differentiating a materials quality model (described later herein) as follows:

[Numerical expression 4]

$$\left(\frac{\partial X}{\partial t}\right) = \frac{X^+ - X^-}{2 \cdot \Delta t} \tag{4}$$

where

Δt is a very insignificant variation (° C.), $X^+$ the material quality at the materials quality sensor position, based on the materials quality model calculations assuming that the interpass time is increased by Δt, and $X^-$ the material quality at the materials quality sensor position, based on the materials quality model calculations assuming that the interpass time is reduced by Δt.

The above also applies to corrections of pass-by-pass outlet-side plate thicknesses (pass schedule) $h^{CAL}$ and of interpass rolling rates (roll-rotating speeds) $V^{CAL}$.

Furthermore, the cooling correction means 13 corrects, for example, a cooling rate in accordance with the data measurements by the materials quality sensor 10, and outputs correction results to the cooling controller 9. The correction uses, for example, the following expression:

[Numerical expression 5]

$$\alpha^{SET} = \alpha^{CAL} - \frac{w_3 \cdot K_3}{\left(\frac{\partial X}{\partial \alpha}\right)} \cdot (X^{ACT} - X^{AIM}) \tag{5}$$

where $\alpha^{SET}$ is an after-correction heating temperature setting (° C./s), $\alpha^{CAL}$ a before-correction heating temperature setting (=calculated setting) (° C./s), $X^{ACT}$ a value measured by the materials quality sensor, $X^{AIM}$ a material quality target value, $$\left(\frac{\partial X}{\partial \alpha}\right)$$

an influence coefficient, $K_3$ a gain (–), and $w_3$ a weighting coefficient (–).

Gain $K_3$ is determined with valve response characteristics and others of the cooler 4 taken into account. Weighting coefficient $W_3$ is determined in consideration of equipment-operating stability and the balance with the corrections conducted by the heating correction means 11, the processing correction means 12, and the cooling correction means 13. The influence coefficient is obtained as follows using a numerical differentiation method:

[Numerical expression 6]

$$\left(\frac{\partial X}{\partial \alpha}\right) = \frac{X^+ - X^-}{2 \cdot \Delta \alpha} \tag{6}$$

where

Δα is a very insignificant variation (° C./s), $X^+$ the material quality at the materials quality sensor position, based on the materials quality model calculations assuming that the cooling rate is increased by Δa, and $X^-$ the material quality at the materials quality sensor position, based on the materials quality model calculations assuming that the cooling rate is reduced by Δa.

Incidentally, a cooler with an array of cooling water nozzles variable in flow rate is often disposed on the outlet side of each rolling mill in a hot-rolling plant. For ferroalloys, aluminum alloys, copper-containing alloys, and titanium-containing alloys, in particular, cooling rates of these alloys and patterns thereof can be varied by changing the flow rate of each such cooler nozzle to manufacture products with varying characteristics, and in this sense, it is extremely important to control the cooler. In such a case, installing a materials quality sensor between a processing site and a cooling site and on the outlet side of a cooling site or at any one of these locations makes it possible to minimize a control delay and thus to conduct more accurate control. A materials quality sensor can, of course, be installed between cooling sites, but in this case, it becomes absolutely necessary to provide a preventive measure against a disturbance in measured data due to, for example, a splash of cooling water.

In the above, a materials quality model is used to calculate in-process changes in materials quality predictively with a pass schedule, a rolling rate, a materials temperature, and other factors as input conditions. Various materials quality models are proposed and commonly known ones consist of the group of numerical expressions that denotes, for example, static recrystallization, static recovery, dynamic recrystallization, dynamic recovery, and grain growth. One such model is described in "Plastic Processing Technology—Series 7, Plate Rolling", pp. 198-229, published by the Corona Publishing Co., Ltd. This textbook describes theoretical equations and their respective originals. The described theoretical equations, however, are established only for part of wide-ranging kinds of alloys, and there are many kinds of alloys for which a theoretical equation is not yet established. A simplified model derived from statistical processing based on actual plant performance data is used as a substitute in such a case. An example of such a simplified model is described in "Materials and Processes", 2004, Vol. 17, p. 227, published by the Iron and Steel Institute of Japan.

Adopting such a construction as set forth above allows the heater 2, the processor 3, and the cooler 4 to be controlled in accordance with data measurements by the internal materials quality sensor 10 of a manufacturing line so that the quality of the material at the measuring position agrees with target data.

SECOND EMBODIMENT

Figure 2:
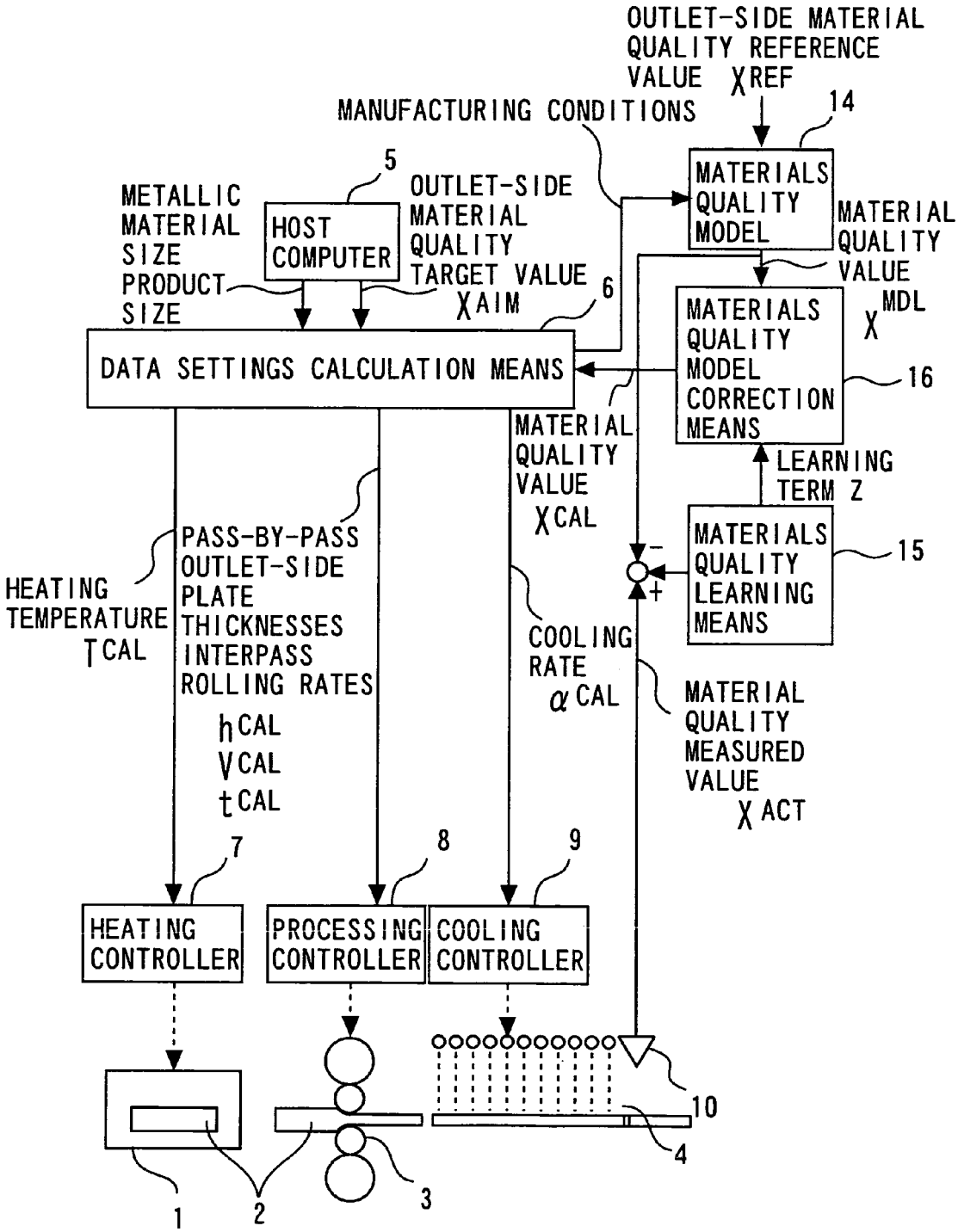
FIG. 2 is a block diagram showing a method and apparatus for controlling materials quality in a rolling, forging, or leveling process according to a second embodiment of the present invention.

FIG. 2 is a block diagram showing a method and apparatus for controlling materials quality in a rolling, forging, or leveling process according to a second embodiment of the present invention.

Operation of a materials quality sensor 10, a heater 2, a processor 3, a cooler 4, a heating controller 7, a processing controller 8, and a cooling controller 9, is the same as in the first embodiment. In addition to target data on a metallic material size, on a product size, and on other factors, a material quality target value $X^{AIM}$ to be achieved at a measuring position of the materials quality sensor 10 is given from a host computer 5, as in the first embodiment. Manufacturing conditions are given from a data settings calculation means 6 to a materials quality model 14, and an outlet-side material quality reference value XRF is given from the host computer 5.

A materials quality learning means 15 compares a value $X^{ACT}$ that has been measured by the materials quality sensor 10, with the material quality value $X^{MDL}$ at a measuring position that has been estimated using the materials quality model, and then a materials quality model correction means 16 introduces modifications in the estimated material quality value $X^{MDL}$, based on comparison results. This materials quality model is the same as that of the first embodiment.

A modification by the materials quality model is conducted, for example, in the following order: First, a correction term Z is provided that is based on materials quality model learning (hereinafter, this term is referred to as the learning term). Zero is assigned as an initial value of Z.

A difference between the value $X^{ACT}$ measured by the materials quality sensor 10, and the material quality value $X^{MDL}$ estimated by the materials quality model before it conducts the modification, is taken as a deviation d after data measurement by the materials quality sensor 10.

[Numerical Expression 7]

$$\delta = X^{ACT} - X^{MDL} \tag{7}$$

This deviation is exponentially smoothed with a value of the learning term existing after an immediately preceding learning operation, and the result obtained is taken as a learning result.

[Numerical Expression 8]

$$Z = (1-\beta)\cdot Z + \beta\cdot\delta \tag{8}$$

where B is a learning gain ranging from 0.0 to 1.0. A learning gain closer to 1.0 increases a learning rate. Increasing this rate, however, makes the learning gain more susceptible to abnormal data, so the gain is usually set to range from about 0.3 to 0.4.

During subsequent calculation of data settings, a value obtained when the value $X^{MDL}$ that has been estimated by the materials quality model is corrected using the following expression is used as an estimated material quality value $X^{CAL}$:

[Numerical Expression 9]

$$X^{CAL} = X^{MDL} + Z \tag{9}$$

It is possible, by executing materials quality model learning based on the value measured by the materials quality sensor 10, to progressively enhance the materials quality model in accuracy as plant operation is continued, and control the heater 2, the processor 3, and the cooler 4 so that material quality of a product or of a semi-finished product will agree with target data.

A method of updating the learning term of the materials quality model is not limited to exponential smoothing. For example, it is possible to use stratified learning adapted to save learning results in a database which uses, as its stratification keys, target plate thickness, target plate width, the kinds of alloys, and other parameters, or to use a neural-network-based learning method that employs similar parameters and the above-mentioned materials quality deviation d as its teaching data.

THIRD EMBODIMENT

Figure 3:
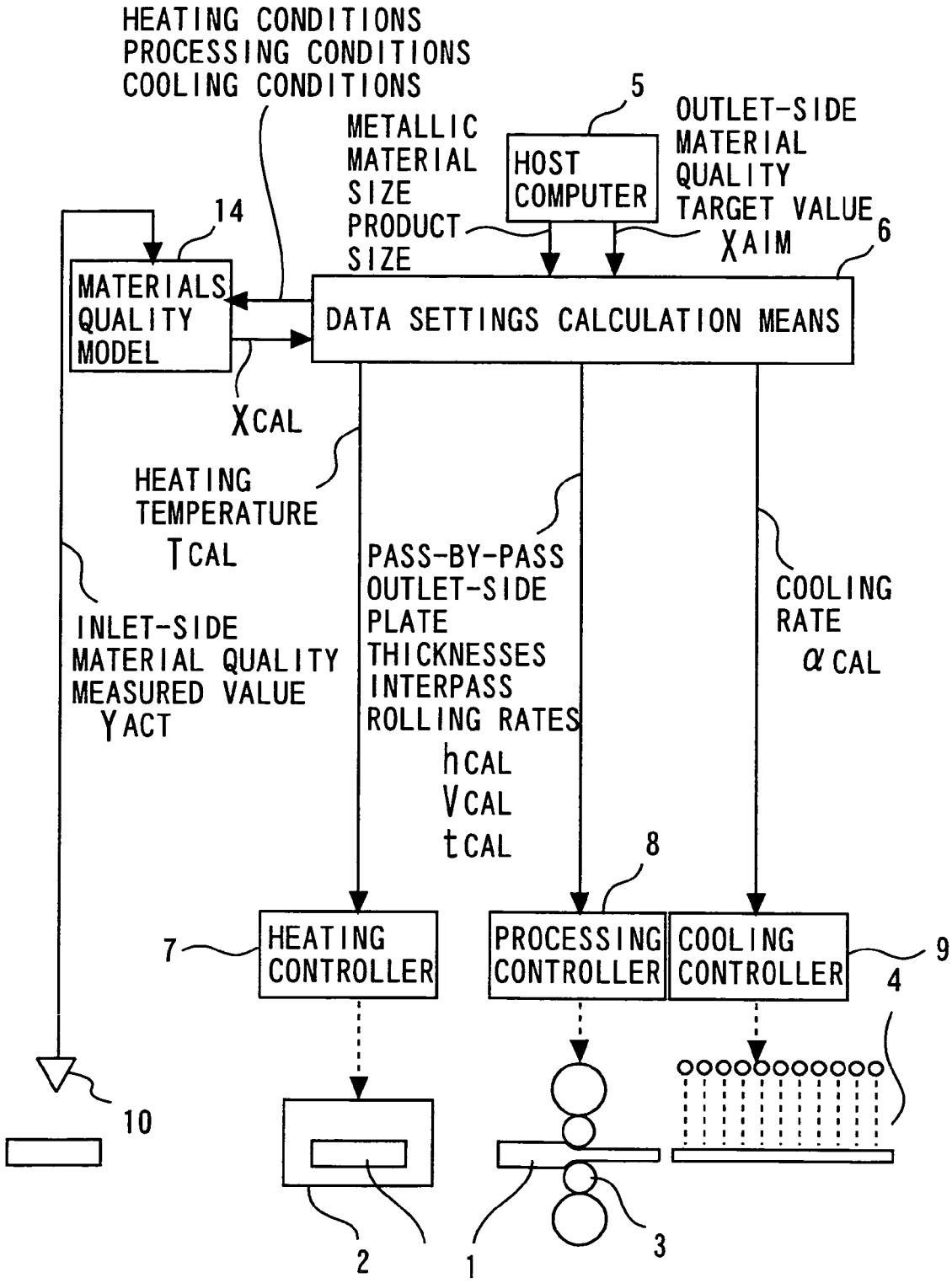
FIG. 3 is a block diagram showing a method and apparatus for controlling materials quality in a rolling, forging, or leveling process according to a third embodiment of the present invention.

FIG. 3 is a block diagram showing a method and apparatus for controlling materials quality in a rolling, forging, or leveling process according to a third embodiment of the present invention.

Operation of a data settings calculation means 6, a heating controller 7, a processing controller 8, a cooling controller 9, a heater 2, a processor 3, and a cooler 4, is the same as in the conventional method and apparatus underlying the present invention.

A materials quality sensor 10 is installed at any position upstream with respect to at least one of the heater 2, processor 3, and cooler 4 in an associated manufacturing line. The heater 2, processor 3, and cooler 4 downstream with respect to the materials quality sensor 10 can each be provided in a plurality of positions and arranged in any order.

In addition, any point on the upstream side with respect to the materials quality sensor 10 in the manufacturing line is defined as a materials quality control point. For a reverse rolling mill, provided that a particular pass is one during which materials quality data has been measured by the materials quality sensor 10, any position on the line can be defined as the materials quality control point, irrespective of physical equipment arrangement. In addition to target data on a size and shape of a metallic material to be controlled, on a target size and shape of a product, on composition (alloying element content) of the metallic material, and on other factors, the material quality target value $X^{AIM}$ called for at the materials quality control point is given from a host computer 5 to the data settings calculation means 6.

Target material quality to be achieved at the materials quality control point may be a material of a type different from the type of material detected by the materials quality sensor 10. For example, during iron and steel hot-strip milling, there is a strong correlation between an austenite grain size on the outlet side of a finish-rolling mill and a ferrite grain size on the inlet side of a winding machine. Therefore, the austenite grain size may be detected using a materials quality sensor installed on the outlet side of the finish-rolling mill, and the ferrite grain size at the materials quality control point set up on the inlet side of the winding machine may be controlled to match to target data.

The materials quality model 14 used is of the same type as that shown in the first embodiment, and when conditions for operating the heater 2, the processor 3, and the cooler 4 are assigned from the settings calculation means 6, the material quality value $X^{CAL}$ estimated at the materials quality control point is calculated with an inlet-side material quality reference value $Y^{ACT}$ as its starting point.

The settings calculation means 6 uses the materials quality model 14 to determine data settings for the heater 2, the processor 3, and the cooler 4, so as to satisfy, in addition to various restrictions, the condition that the material quality value $X^{CAL}$ estimated at the materials quality control point should be matched to the material quality target value $X^{AIM}$.

The heating conditions, processing conditions, and cooling conditions that satisfy the above conditions can be obtained by, for example, repeating several times such correcting operations as described below.

First, a heating temperature data setting for the heater is corrected as follows:

[Numerical expression 10]

$$T^{CAL} \leftarrow T^{CAL} - \frac{w_1 \cdot K_1}{\left(\frac{\partial X}{\partial T}\right)} \cdot (X^{CAL} - X^{AIM}) \tag{10}$$

where $T^{CAL}$ a heating temperature setting (° C.), $X^{CAL}$ the material quality value estimated at the materials quality control point by materials quality model calculation with the inlet-side material quality reference value $Y^{ACT}$ as its starting point, $X^{AIM}$ the material quality target value at the materials quality control point, $$\left(\frac{\partial X}{\partial T}\right)$$

an influence coefficient, $K_1$ a gain (–), and $w_1$ a weighting coefficient (–).

Gain $K_1$ and weighting coefficient $w_1$ are determined similarly to those of the first embodiment. The influence coefficient is obtained by numerically differentiating the materials quality model as follows:

[Numerical expression 11]

$$\left(\frac{\partial X}{\partial T}\right) = \frac{X^{+} - X^{-}}{2 \cdot \Delta T} \tag{11}$$

where $\Delta T$ is a very insignificant variation (° C.), $X^{+}$ the material quality to be achieved at the materials quality control point, based on the materials quality model calculations assuming that the heating temperature is increased by $\Delta T$, and $X^{-}$ the material quality to be achieved at the materials quality control point, based on the materials quality model calculations assuming that the heating temperature is reduced by $\Delta T$.

Next, pass-by-pass outlet-side plate thicknesses $h^{CAL}$, interpass rolling rates $V^{CAL}$, or interpass standby time periods $t^{CAL}$ are corrected to obtain appropriate processing conditions of the material at the processor, such as pass-by-pass deformation levels, pass-by-pass deformation rates, and pass-by-pass processing intervals. Either interpass standby time period $t^{CAL}$, for example, is corrected using the following expression:

[Numerical expression 12]

$$t^{CAL} \leftarrow t^{CAL} - \frac{w_2 \cdot K_2}{\left(\frac{\partial X}{\partial t}\right)} \cdot (X^{CAL} - X^{AIM}) \tag{12}$$

where $t^{CAL}$ an interpass time setting (sec), $X^{CAL}$ the material quality value estimated at the materials quality control point by materials quality model calculation, $X^{AIM}$ the material quality target value at the materials quality control point, $$\left(\frac{\partial X}{\partial t}\right)$$

an influence coefficient, $K_2$ a gain (–), and $w_2$ a weighting coefficient (–).

Gain $K_2$ and weighting coefficient $w_2$ are determined similarly to those of the first embodiment. The influence coefficient is obtained by numerically differentiating the materials quality model as follows:

Each pass-by-pass outlet-side plate thickness $h^{CAL}$ or each interpass rolling rate $V^{CAL}$ is also corrected in essentially the same manner.

[Numerical expression 13]

$$\left(\frac{\partial X}{\partial t}\right) = \frac{X^+ - X^-}{2 \cdot \Delta t} \tag{13}$$

where $\Delta t$ is a very insignificant variation (° C.), $X^+$ the material quality to be achieved at the materials quality control point, based on the materials quality model calculations assuming that the heating temperature is increased by $\Delta t$, and $X^-$ the material quality to be achieved at the materials quality control point, based on the materials quality model calculations assuming that the heating temperature is reduced by $\Delta t$.

Additionally, the cooling rate is corrected. This correction uses, for example, the following expression:

[Numerical expression 14]

$$\alpha^{CAL} \leftarrow \alpha^{CAL} - \frac{w_3 \cdot K_3}{\left(\frac{\partial X}{\partial \alpha}\right)} \cdot (X^{CAL} - X^{AIM}) \tag{14}$$

where $\alpha^{CAL}$ a cooling rate setting (° C./s), $X^{CAL}$ the material quality value estimated at the materials quality control point by materials quality model calculation, $X^{AIM}$ a material quality target value, $$\left(\frac{\partial X}{\partial \alpha}\right)$$

an influence coefficient, $K_3$ a gain (–), and $w_3$ a weighting coefficient (–).

Gain $K_3$ and weighting coefficient $W_3$ are determined similarly to those of the first embodiment. The influence coefficient is obtained by numerically differentiating the materials quality model as follows:

[Numerical expression 15]

$$\left(\frac{\partial X}{\partial \alpha}\right) = \frac{X^+ - X^-}{2 \cdot \Delta \alpha} \tag{15}$$

where $\Delta\alpha$ is a very insignificant variation (° C./s), $X^+$ the material quality to be achieved at the materials quality control point, based on the materials quality model calculations assuming that the cooling rate is increased by $\Delta a$, and $X^-$ the material quality to be achieved at the materials quality control point, based on the materials quality model calculations assuming that the cooling rate is reduced by $\Delta a$.

Adopting such a construction as set forth above allows the heater, the processor, and the cooler to be controlled in accordance with the data measurements of a raw material or a partly-finished product by the materials quality sensor of a manufacturing line so that the quality of the material at the measuring position agrees with target data.

FOURTH EMBODIMENT

Figure 4:
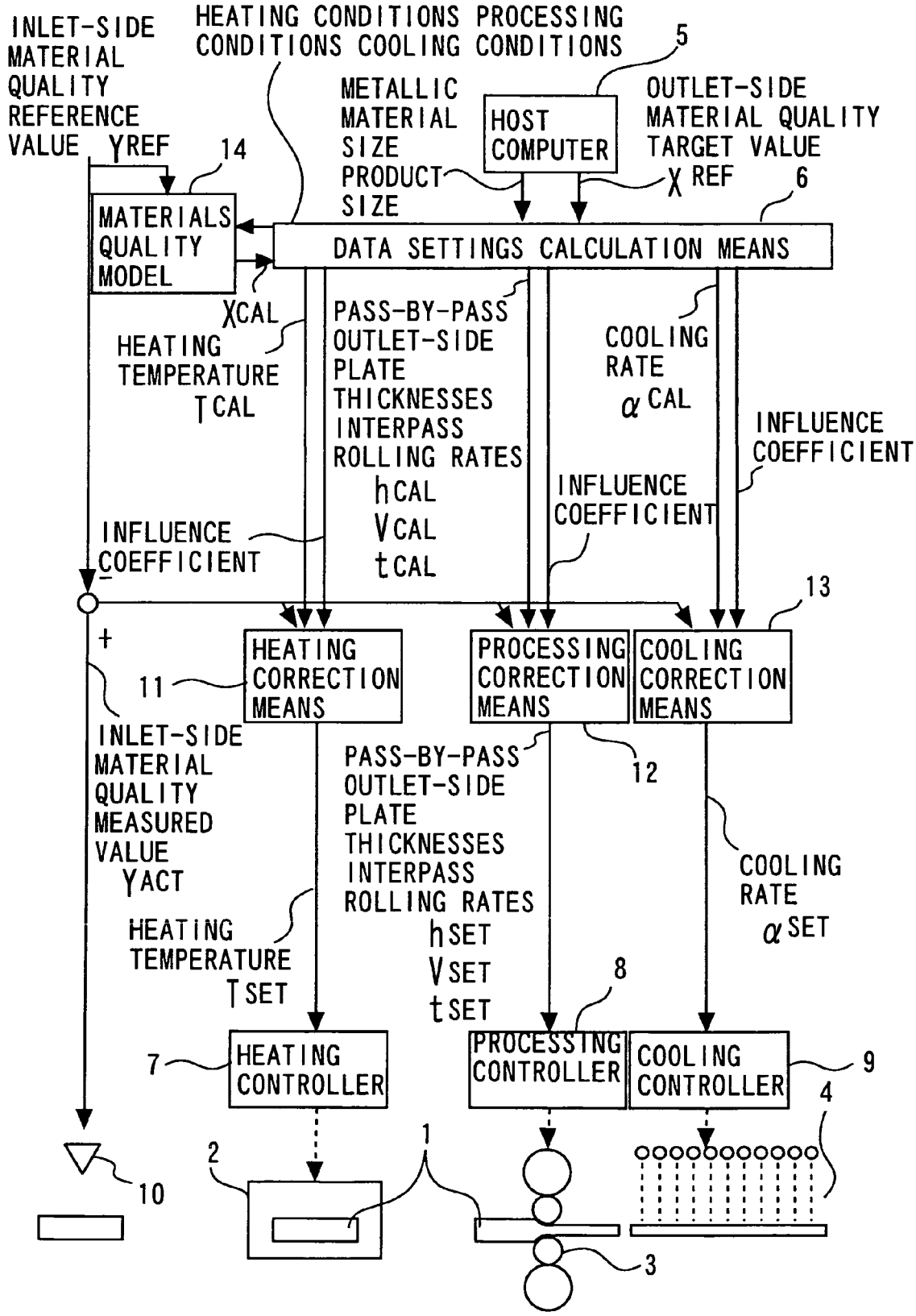
FIG. 4 is a block diagram showing a method and apparatus for controlling materials quality in a rolling, forging, or leveling process according to a fourth embodiment of the present invention.

FIG. 4 is a block diagram showing a method and apparatus for controlling materials quality in a rolling, forging, or leveling process according to a fourth embodiment of the present invention.

Operation of a data settings calculation means 6, a heating controller 7, a processing controller 8, a cooling controller 9, a heater 2, a processor 3, and a cooler 4, is the same as in the conventional method and apparatus underlying the present invention. In addition, an inlet-side material quality reference value $Y^{REF}$ is given, as in the third embodiment.

The materials quality model 14 used is of the same type as that shown in the first embodiment, and when conditions for operating the heater 2, the processor 3, and the cooler 4 are assigned from the settings calculation means 6, the material quality value $X^{CAL}$ estimated at a materials quality control point is calculated with the inlet-side material quality reference value $Y^{REF}$ as its starting point.

Before a material to be controlled arrives at a materials quality sensor, the settings calculation means 6 determines data settings for the heater 2, the processor 3, and the cooler 4, as in the conventional method and apparatus underlying the present invention. When the material arrives at the materials quality sensor and an actual material quality value (hereinafter, referred to as an actual inlet-side material quality value $Y^{ACT}$) is obtained, this value is compared with the inlet-side material quality reference value $Y^{REF}$. In accordance with comparison results, a heating correction means, a processing correction means, and a cooling correction means conduct corrections on calculated data settings such as a heating temperature, pass-by-pass outlet-side plate thicknesses, pass-by-pass rolling temperatures, and a cooling rate.

The heating correction means 11 corrects the heating temperature on the basis of the value measured by materials quality sensor 10, and outputs correction results to the heating controller 7. This correction uses, for example, the following expression:

[Numerical expression 16]

$$T^{SET} = T^{CAL} - \frac{w_1 \cdot K_1}{\left(\frac{\partial X}{\partial T}\right)} \cdot \left(\frac{\partial X}{\partial Y}\right) \cdot (Y^{ACT} - Y^{REF}) \tag{16}$$

where $T^{SET}$ is an after-correction heating temperature setting (° C.), $T^{CAL}$ a before-correction heating temperature setting (=calculated setting) (° C.), $Y^{ACT}$ the value measured by the materials quality sensor,
$Y^{REF}$ a material quality target value, $$\left(\frac{\partial X}{\partial T}\right)$$

$$\left(\frac{\partial X}{\partial Y}\right)$$

an influence coefficient, an influence coefficient,
$K_1$ a gain (–), and
$w_1$ a weighting coefficient (–).

Gain $K_1$, weighting coefficient $w_1$, and the influence coefficient $$\left(\frac{\partial X}{\partial T}\right)$$

are determined similarly to those of the first embodiment. The influence coefficient $$\left(\frac{\partial X}{\partial Y}\right)$$

is obtained by numerically differentiating a materials quality model (described later herein) as follows:

[Numerical expression 17]

$$\left(\frac{\partial X}{\partial Y}\right) = \frac{X^+ - X^-}{2 \cdot \Delta Y} \tag{17}$$

where
$\Delta Y$ is a very insignificant variation in material quality
Y at the materials quality sensor position,
$X^+$ the material quality at the materials quality sensor position, based on the materials quality model calculations assuming that the heating temperature is increased by $\Delta T$, and
$X^-$ the material quality at the materials quality sensor position, based on the materials quality model calculations assuming that the heating temperature is reduced by $\Delta T$.

Although the above calculation is desirably conducted online from actual equipment-operating conditions (such as the material temperature), if gain $K_1$ is reduced, a value that has been previously calculated off-line from standard operating conditions can be used as an alternative.

Next, in accordance with data measurements by the materials quality sensor 10, the processing correction means 12 corrects pass-by-pass outlet-side plate thicknesses $h^{CAL}$, interpass rolling rates $V^{CAL}$, or interpass standby time periods $t^{CAL}$, so as to obtain appropriate processing conditions of the material at the processor 3, such as pass-by-pass deformation levels, pass-by-pass deformation rates, and pass-by-pass processing intervals. Correction results are output to the processing controller 8. Either interpass time period, for example, is corrected using the following expression:

[Numerical expression 18]

$$t^{SET} = t^{CAL} - \frac{w_2 \cdot K_2}{\left(\frac{\partial X}{\partial t}\right)} \cdot \left(\frac{\partial X}{\partial Y}\right) \cdot (Y^{ACT} - Y^{REF}) \tag{18}$$

where
$t^{SET}$ is an after-correction interpass time period setting (sec),
$T^{CAL}$ a before-correction heating interpass time period setting (=calculated setting) (sec),
$Y^{ACT}$ a value measured by the materials quality sensor,
$Y^{REF}$ a material quality target value, $$\left(\frac{\partial X}{\partial Y}\right)$$

an influence coefficient, $$\left(\frac{\partial X}{\partial t}\right)$$

an influence coefficient,
$K_2$ a gain (–), and
$w_2$ a weighting coefficient (–).

Gain $K_2$, weighting coefficient $w_2$, and the influence coefficient $$\left(\frac{\partial X}{\partial t}\right)$$

are determined similarly to those of the first embodiment. The influence coefficient $$\left(\frac{\partial X}{\partial Y}\right)$$

is calculated in a manner similar to that of calculation with the heating correction means.

Furthermore, the cooling correction means 12 corrects, for example, a cooling rate in accordance with the data measurements by the materials quality sensor 10, and outputs correction results to the cooling controller 9. The correction uses, for example, the following expression:

[Numerical expression 19]

$$\alpha^{SET} = \alpha^{CAL} - \frac{w_3 \cdot K_3}{\left(\frac{\partial X}{\partial \alpha}\right)} \cdot \left(\frac{\partial X}{\partial Y}\right) \cdot (Y^{ACT} - Y^{REF}) \tag{19}$$

where
$\alpha^{SET}$ is an after-correction cooling rate setting (° C./s),
$\alpha^{CAL}$ a before-correction cooling rate setting (=calculated setting) (° C./s),
$Y^{ACT}$ a value measured by the materials quality sensor, $Y^{REF}$ a material quality target value, $$\left(\frac{\partial X}{\partial Y}\right)$$

$$\left(\frac{\partial X}{\partial \alpha}\right)$$

an influence coefficient, an influence coefficient, $K_3$ a gain (–), and $w_3$ a weighting coefficient (–).

Gain $K_3$, weighting coefficient $w_3$, and the influence coefficient $$\left(\frac{\partial X}{\partial \alpha}\right)$$

are determined similarly to those of the first embodiment. The influence coefficient $$\left(\frac{\partial X}{\partial Y}\right)$$

is calculated in a manner similar to that of calculation with the heating correction means.

Adopting such a construction as set forth above allows the heater, the processor, and the cooler to be controlled in accordance with untreated or semi-finished materials data measurements by the internal materials quality sensor of a manufacturing line so that the quality of the material at the materials quality control point agrees with target data.

INDUSTRIAL APPLICABILITY

The method and apparatus for controlling materials quality in a rolling, forging, or leveling process according to the present invention can be applied particularly to materials quality control in an iron-and-steel hot-rolling line which uses a laser-ultrasonic crystal gain size sensor and an induction heater.

What is claimed is:

1. An apparatus for controlling materials quality in a rolling, forging, or leveling process, the apparatus comprising:

at least one of a heater for heating a metallic material, a processor for processing a metallic material by at least one of rolling, forging, and leveling the metallic material, and a cooler for cooling the metallic material;

data settings calculation means connected to a manufacturing line for manufacturing a metallic product of desired size and shape, wherein, in accordance with information on size and shape of the metallic material, on target size and shape of the product, and on composition of the metallic material, the information being output by a host computer, the data settings calculation means calculates and outputs data settings for the heater, the processor, and the cooler;

a heating controller, a processing controller, and a cooling controller which control the heater, the processor, and the cooler, respectively, based on the data settings;

a materials quality sensor installed downstream of at least one of the heater, the processor, and the cooler in the manufacturing line, the materials quality sensor generating ultrasonic waves in the metallic material by irradiating the metallic material with exciting laser light, and detecting the ultrasonic waves propagated in the metallic material based on interference between the exciting laser light irradiating the metallic material and reflected exciting laser light reflected from the metallic material, and measuring quality of the metallic material based on ultrasonic wave propagation characteristics of the ultrasonic waves detected; and heating correction means, processing correction means, and cooling correction means, for calculating deviation between target quality data of the metallic material and the quality of the metallic material that is measured, calculating an influence coefficient of influence on the quality of the metallic material that is measured, at a material quality measuring point, from changes in heating controlled by the heating controller, changes in processing conditions controlled by the processing controller, and changes in cooling conditions controlled by the cooling controller, using a materials quality model based on a schedule of passage of the metallic material through the manufacturing line, rolling rate of the metallic material, and temperature of the metallic material, determining correction gains of each of the heating controller, the processing controller, and the cooling controller based on control response and transfer time of each of the heating controller, the processing controller, and the cooling controller at the material quality measuring point, and determining weighting coefficients of the correction gains of each of the heating controller, the processing controller, and the cooling controller, and based on the deviation of the quality of the metallic material that is measured from the target quality data, the influence coefficients, the correction gains, and the weighting coefficients, correcting the data settings output by the data settings calculation means to the heater, the processor, and the cooler, upstream of the materials quality sensor.

2. An apparatus for controlling materials quality in a rolling, forging, or leveling process, the apparatus comprising:

at least one of heating means for heating a metallic material, processing means for processing a metallic material by at least one of rolling, forging, and leveling the metallic material, and cooling means for cooling the metallic material;

data settings calculation means connected to a manufacturing line for manufacturing a metallic product of desired size and shape, wherein, in accordance with information on size and shape of the metallic material, on target size and shape of the product, and on composition of the metallic material, the information being output by a host computer, the data settings calculation means calculates and outputs data settings for the heating means, the processing means, and the cooling means;

a heating controller, a processing controller, and a cooling controller which control the heating means, the processing means, and the cooling means, respectively, based on the data settings;

a materials quality sensor installed downstream of at least one of the heating means, the processing means, and the cooling means in the manufacturing line, the materials quality sensor generating ultrasonic waves in the metallic material by irradiating the metallic material with exciting laser light, and detecting the ultrasonic waves propagated in the metallic material based on interference between the exciting laser light irradiating the metallic material and reflected exciting laser light reflected from the metallic material, and measuring quality of the metallic material based on ultrasonic wave propagation characteristics of the ultrasonic waves detected;

materials quality model computing means for estimating, using a materials quality model, the quality of the metallic material, at a measuring position, from actual heating conditions, processing conditions, and cooling conditions of the metallic material;

materials quality model learning means for comparing data measurements by the materials quality sensor to arithmetic results output by the materials quality model computing means, and identifying, from the comparing, an error in the materials quality model; an materials quality model correction means for correcting the materials quality model by correcting the arithmetic results output by the materials quality model computing means in accordance with the error output by the materials quality model learning means, wherein the data settings calculation means calculates and outputs data settings for each of the heating means, the processing means, and the cooling means, in accordance with as-corrected-material quality data estimates that the materials quality model correction means outputs.

3. An apparatus for controlling materials quality in a rolling, forging, or leveling process, the apparatus comprising:

at least one of heating means for heating a metallic material, processing means for processing a metallic material by at least one of rolling, forging, and leveling the metallic material, and cooling means for cooling the metallic material;

data settings calculation means connected to a manufacturing line for manufacturing a metallic product of desired size and shape, wherein, in accordance with information on size and shape of the metallic material, on target size and shape of the product, and on composition of the metallic material, the information being output by a host computer, the data settings calculation means calculates and outputs data settings for the heating means, the processing means, and the cooling means;

a heating controller, a processing controller, and a cooling controller which control the heating means, the processing means, and the cooling means, respectively, based on the data settings;

a materials quality sensor installed downstream of at least one of the heating means, the processing means, and the cooling means in the manufacturing line, the materials quality sensor generating ultrasonic waves in the metallic material by irradiating the metallic material with exciting laser light, and detecting the ultrasonic waves propagated in the metallic material based on interference between the exciting laser light irradiating the metallic material and reflected exciting laser light reflected from the metallic material, and measuring quality of the metallic material based on ultrasonic wave propagation characteristics of the ultrasonic waves detected; and materials quality model computing means for estimating, using a materials quality model, the quality of the metallic material at a materials quality control point located at a position downstream with respect to the materials quality sensor, wherein the data settings calculation means calculates and outputs data settings for each of the heating means, the processing means, and the cooling means so that arithmetic results output by the materials quality model computing means will agree with target quality data of the metallic material output by the host computer.

4. An apparatus for controlling materials quality in a rolling, forging, or leveling process, the apparatus comprising:

at least one of a heater for heating a metallic material, a processor for processing a metallic material by at least one of rolling, forging and leveling the metallic material, and a cooler for cooling the metallic material;

data settings calculation means connected to a manufacturing line for manufacturing a metallic product of desired size and shape, wherein, in accordance with information on size and shape of the metallic material, on target size and shape of the product, and on composition of the metallic material, the information being output by a host computer, the data settings calculation means calculates and outputs data settings for the heater, the processor, and the cooler;

a heating controller, a processing controller, and a cooling controller which control the heater, the processor, and the cooler, respectively, based on the data settings;

a materials quality sensor installed downstream of at least one of the heater, the processor, and the cooler in the manufacturing line, the materials quality sensor generating ultrasonic waves in the metallic material by irradiating the metallic material with exciting laser light, and detecting the ultrasonic waves propagated in the metallic material based on interference between the exciting laser light irradiating the metallic material and reflected exciting laser light reflected from the metallic material, and measuring quality of the metallic material based on ultrasonic wave propagation characteristics of the ultrasonic waves detected; and heating correction means, processing correction means, and cooling correction means for calculating deviation between target quality data of the metallic material and the quality of the metallic material that is measured, calculating an influence coefficient of influence on the quality of the metallic material at a material quality control point, downstream of a material quality measuring point, from changes in material quality of the metallic material measured at the material quality measuring point, calculating an influence coefficient of influence on quality of the metallic material that is measured, at the material quality control point, from changes in heating controlled by the heating controller, changes in processing conditions controlled by the processing controller, and changes in cooling conditions controlled by the cooling controller, using a materials quality model based on a schedule of passage of the metallic material through the manufacturing line, rolling rate of the metallic material, and temperature of the metallic material, determining correction gains of each of the heating controller, the processing controller, and the cooling controller based on control response and transfer time of each of the heating controller, the processing controller, and the cooling controller at the material quality measuring point, and determining weighting coefficients of the correction gains of each of the heating controller, the processing controller, and the cooling controller, and based on the deviation of the quality of the metallic material that is measured from the target quality data, the influence coefficients, the correction gains, and the weighting coefficients, correcting the data settings output by the data settings calculation means to the heater, the processor, and the cooler, upstream of the materials quality sensor, correcting the data settings output from the data settings calculation means to the heater, the processor, and the cooler disposed downstream with respect to the materials quality sensor.

* * * * *